US005080034A

United States Patent [19]

Bjork, Sr. et al.

[11] Patent Number: 5,080,034

[45] Date of Patent: Jan. 14, 1992

[54] SEA-PRESSURED AIR POCKET SHIP/BARGE DESIGN

[76] Inventors: Glen O. Bjork, Sr.; Betty W. Bjork, both of 2751 Briarwood Cir., Moss Point, Miss. 39563

[21] Appl. No.: 287,271

[22] Filed: Dec. 21, 1988

Related U.S. Application Data

[63] Continuation-in-part of Ser. No. 106,593, Oct. 13, 1987, abandoned.

[51] Int. Cl.[5] ..... B63B 43/14

[52] U.S. Cl. ..... 114/123

[58] Field of Search ..... 114/67 RA, 68, 69, 121, 114/122, 123, 240 D; 180/127

[56] References Cited

U.S. PATENT DOCUMENTS 3,120,832 2/1964 Buisson ..... 114/68

3,134,354 5/1964 Smith ..... 114/68

3,379,270 4/1968 Hardy et al. ..... 114/67 A

*Primary Examiner*—Jesus D. Sotelo

[57] ABSTRACT

A surface ship or barge design employing an exterior hull skirt to contain sea-pressured (air) between the inside of the skirt and the underside of the hull. Compressed air may be utilized with pressure control and air relieving capabilities to the contained air pocket or pockets for the purpose of varying the sea-pressured air pressure and subsequently the surface vessel's draft depth. The design or design improvement enhances a surface vessels capabilities by permitting heavier loads to be carried, navigation in shallower channels, increased bouyancy, improved resistance to wave motions, less friction drag, better cost efficiency, and hull damage protection.

2 Claims, 4 Drawing Sheets

LEGEND

RELIEF VALVE

PRESSURE REGULATOR

PRESSURE GAUGE

CONTROL VALVE

SHUT-OFF VALVE

AIR ACCUMULATOR

STOP CHECK VALVE

PIPE LINE

SEA-PRESSURED AIR POCKET SHIP/BARGE DESIGN

This application is a continuation-in-part of pending prior application, Ser. No. 07/106,593, filed on Oct. 13, 1987 of Glen O. Bjork, Jr. and Betty W. Bjork, joint inventors, for SEA-PRESSURED AIR POCKET SHIP/BARGE DESIGN, now abandoned.

FIELD OF INVENTION

The present invention relates to design of surface ships and barges, or as a design addition to existing surface vessels to improve their water going capabilities.

BACKGROUND OF THE INVENTION

A variety of surface ship and barge design configurations exist, resulting in differing size, length, water displacement, draft depth, stability, speed, efficiency, weight and equipment carrying capabilities. Conventional ships or barges have in general; V-shaped, U-shaped, twin, or nearly flat bottom hulls. Some include devices to improve their capabilities, such as wing or fin stabilizers, anti-roll tanks, transom stern, fixed fin, and flared or bulb-shaped bows. Some are designed with sea ballast provisions to increase the ships draft depth and to balance or steady it.

The aforesaid surface ship or barge designs are acceptable for their intended purposes, but none of them utilize a sea-pressured air pocket exterior hull skirt to enhance their capabilities as this invention does.

SUMMARY OF THE INVENTION

This improved surface ship or barge design invention imploys a hull skirt which may begin in the vicinity of the full load water line and extend downward, generally vertically to or near the level of the hull bottom or baseline. The skirt may be of various shipbuilding materials; such as metal, wood, or reinforced plastic, to name a few. The skirt will serve to trap or contain air between the underside of the hull and the inside of the skirt. The skirt may be braced to the hull to hold it firm and provide a space or pocket for sea-pressured air to be maintained.

A compressed air source may be provided with pressure control and air relieving capabilities to the skirt air pocket for the purpose of varying the air pressure and subsequently the draft depths, if desired. The ships draft depth may be changed and controlled, depending on the the amount of water displaced by the air pressure maintained in the air pocket(s) under the hull skirt.

The hull skirt may partially or completely surround the hull. It may have compartments which may be pressure controlled individually, if desired. It may extend below or above the bottom of the hull. It may begin above or below the water line. It may be vertically straight, convex, or concave, either wholly or in part. It may be strictly vertical or slanted inward or outward from the hull. The skirt and bracing shall be designed structurally strong enough to withstand the pressures and loads required of them. The skirt shall be pressure tight with the hull.

The invention provides for the surface ship/barge to be buoyed up or lowered in the water by providing controlled sea-pressured air on the underside of the surface vessel between the hull and the underside of the skirt. The weight carry capability of the surface vessel will increase by the amount of water displaced by the air, less the weight of the skirt with braces and the attendant air with its air pressurizing, relieving, control equipment and supporting fuel. The surface vessels under skirt seawater level will be at a lower water level than the vessels outer water line level and being open to the sea from the bottom side will help maintain air pressure trapped within at a pressure equal to the water head difference. This under vessel air pressure force will buoy up the surface vessel allowing larger loads or equipment to be carried for a given draft depth. The air pressure may also be vented from the pocket(s) allowing the vessel to float lower in the water.

DESCRIPTION OF THE INVENTION

Figure 1:
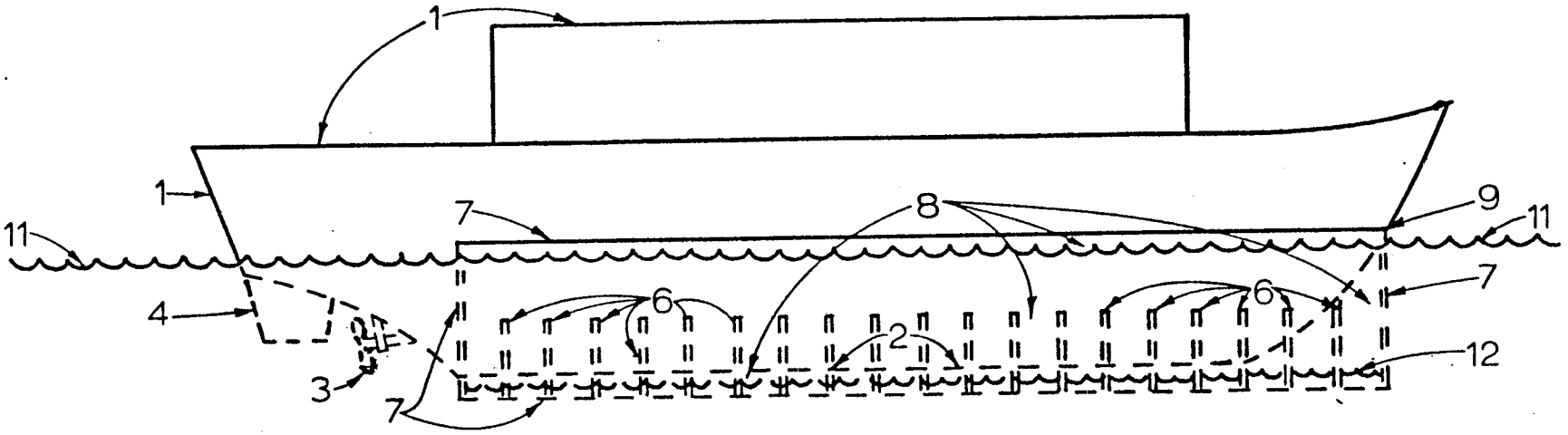
FIG. 1 is a side view of a surface ship with a hull skirt beginning at the bow and encompassing a major portion of the ships unerwater portion of its hull. The rear, minor portion of the ships hull, wherein the propeller and rudder are located is not encompassed by the skirt. The hull skirt extends to just below the hull base line and commences slightly above the water line in this drawing.
Figure 2:
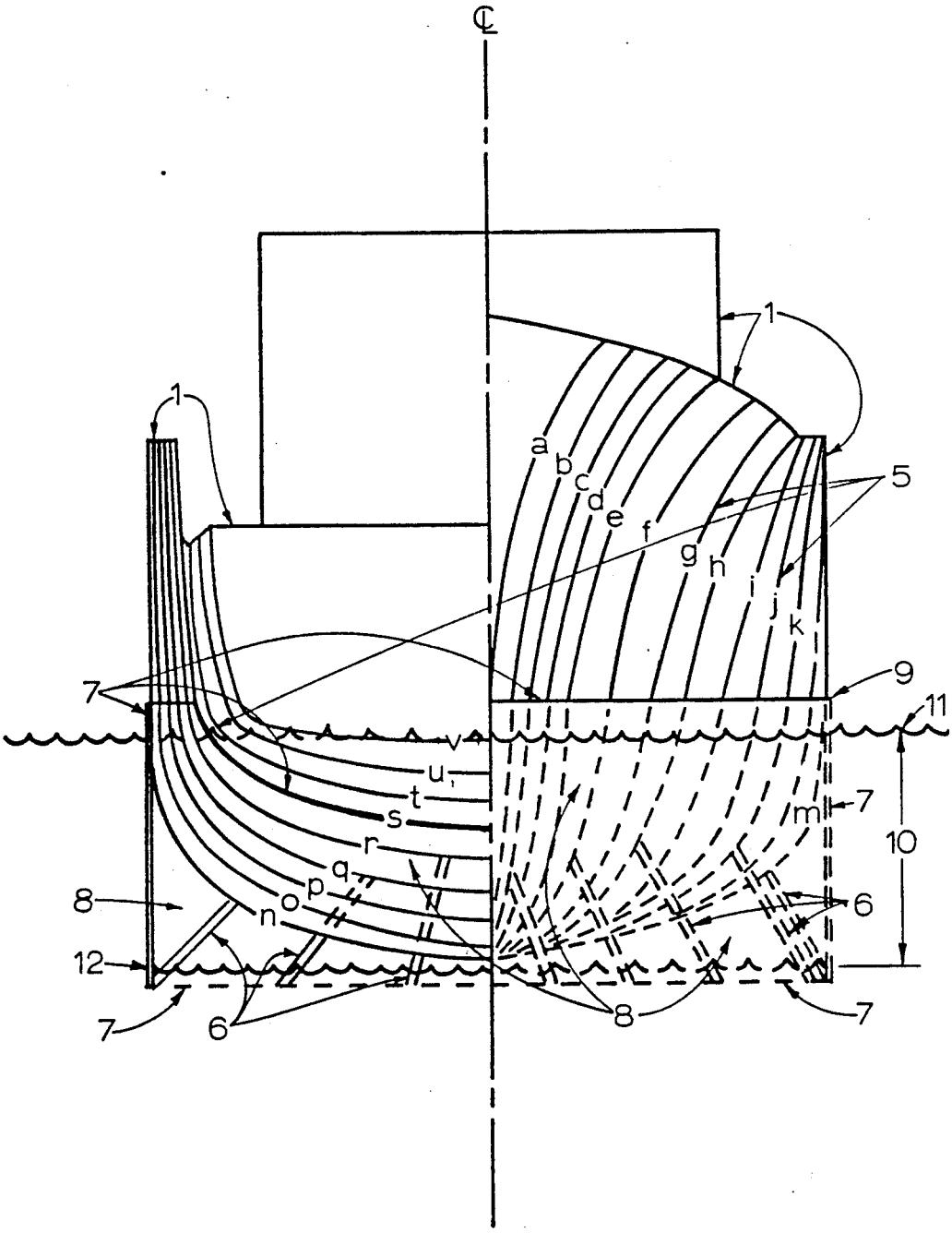
FIG. 2 is an end cutaway view of a surface ship hull form with a hull skirt as described in FIG. 1 aforesaid. The sea-pressure air pocket encompasses a major portion of the underwater hull commencing at the bow end. The volume of air in the air pocket will be maintained at a pressure equal to the differential water head sea pressure between the draft water level and the underskirt seawater level. This displaced water air pocket volume will be maintained by the differential seawater head pressure and may be varied and controlled by a compressed air supply with relieving capabilities. Changing the air volume subsequently changes the seawater head difference and thereby changes the draft level.
Figure 3:
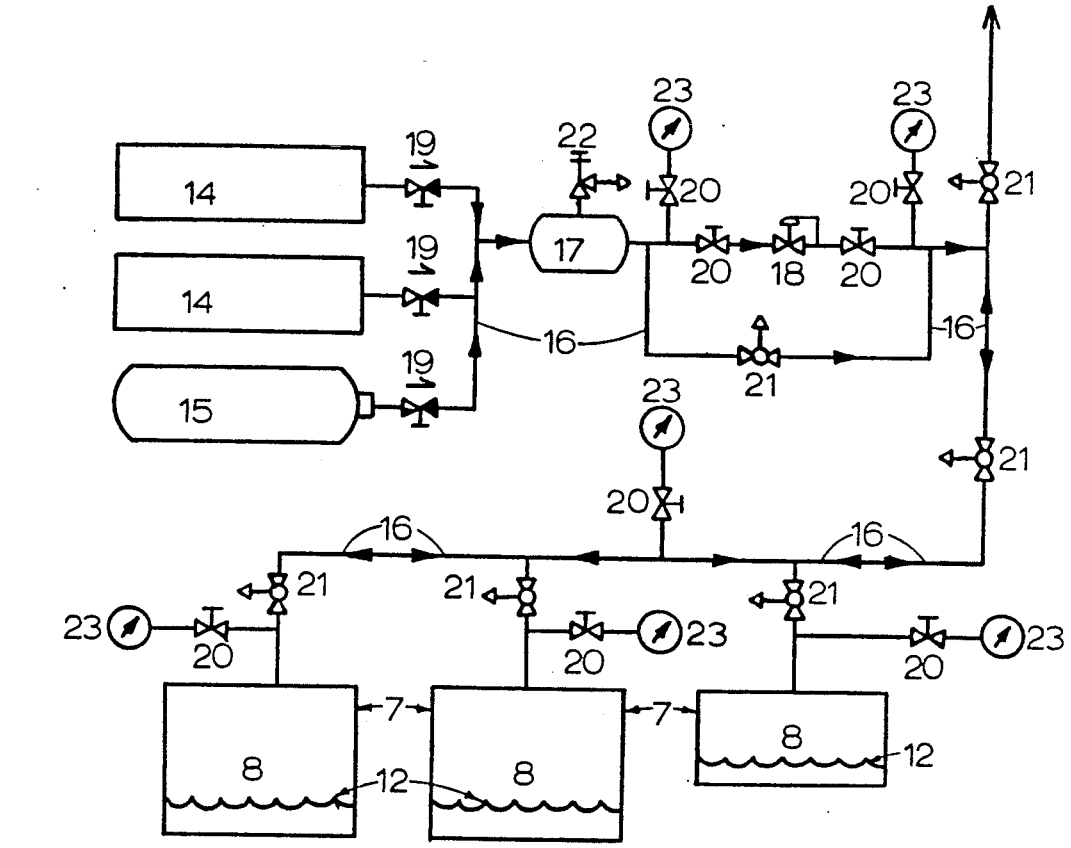
FIG. 3 is a diagramatic drawing of an air pressurization, venting and control system. One or more air compressors or compressed gas sources may be utilized and the surface ship/barge may have one or more air pockets.

The surface ship 1 shown with its skirt as FIG. 1 with typical cut away end view shown in FIG. 2 and accompanied by a compressed gas source with its attendant pressure control and venting capabilities as shown generally by diagrammatic drawing FIG. 3, set forth the preferred embodiment by the inventors for carrying out their invention.

The apparatus shown by FIGS. 1, 2, and 3 are suitable for varying the ships' Draft Water Level 11 to permit heavier loads to be carried for a given draft depth. The underwater hull shapes as depicted by transverse frame lines 5*a* through 5*v*, generally shown, with surrounding vertical skirt 7 with braces 6 and air pockets 8 commence in the vicinity of the Full Load Water Level 9 and extend to the vicinity of the hull baseline 2. The hull skirt begins at the bow end generally with a rather sharp tapered forward end extending vertically downward from top to bottom and continues around both starboard and portsides and then terminates across the stern end just forward of the propeller 3 area, as required for suitable propeller and rudder 4 action.

When pressurized with air or gas from top of the air pockets 8 down to the underskirt water level 12 in the vicinity of the baseline of the hull 2, the ship is buoyed up by the total differential seawater head pressure 10 against nearly the entire underwater skirted hull surface area as calculated from the Draft Water Level 11 to the Under Skirt Seawater Level 12. Without the skirt attached and sea-pressured air pockets, the buoyancy force produced by the sea against the underwater hull would be smaller and would vary from zero at the Draft Water Level to a maximum differential water head pressure force at the hull baseline. The added weight of the skirt with its required braces 6 and attended gas or air system requirements will lessen the buoyancy effect, but will be designed to add minimal weight, which will be more than offset by the force added upward inside the ships' skirt against the hull.

The increased ships' buoyancy will permit navigation through shallower waterways. Better vessel stability and resistance to wave motions that cause rolling, pitching, heaving, swaying, and surging will be realized because the skirt and the air pockets will serve to substantially inhibit these offensive wave motions. The rolling and pitching movements will be minimized because as the ship tilts, the lowered end of the ships' skirt will develop water pressure and a righting moment force against its inside skirt surface as the gas pocket rises. Also, the gas pressure increase in the moment due to a more horizontal hull surface area for the gas pressure to work against. Resistance to heaving motions will be increased both in height and velocity because of the dampening effect of the gas pockets to the heaving force against the ships' hull. Partial protection from hull damage will be afforded by the surrounding hull skirt with its attendant gas pockets from underwater or surface objects such as mine explosives and other objects. Better operating cost efficiencies as a result of greater weight carrying capacities and/or increased speed will be afforded due to less friction drag exerted by the water particles on a lessened area of the skirted hull of the moving ship as compared with a non-skirted hull. The underwater hull and skirt surface area in contact with the water will be reduced because of a smaller draft depth and also the gas pockets. The water/gas friction will be very minor compared with the water/-hull friction.

When the ships apparatus is active, as addressed below, air compressors 14 or compressed gas bottles 15 diagrammatically shown in general by FIG. 3 coupled to sea-pressured gas pockets 8 via pipe lines 16, air accumulator 17, pressure regulator 18, stop check valves 19, shut off valves 20 control valves 21, relief valves 22, and pressure gauges 23, inflates the gas pockets until they are full of gas to the vicinity of the baseline 2 of the ship 1 and slightly above the bottom of the skirt 7 at the underwater seawater level 12. Thereafter, air compressors 14 or gas bottles 15 supply gas only as necessary to replace gas that may escape from air pockets 8 when seas are rough or as a result of water logging of the air pockets. Gas may be removed from the air pockets by operation of the control valves 21. Under skirt seawater levels 12 and subsequent ship draft depths can be controlled by monitoring the pressure gauges 23 and regulating the gas pressure in the air pockets as desired. The pressure regulator 18 may be utilized to automatically feed gas to the air pockets as make-up gas, if desired, to maintain a desired ship's draft depth. Diagrammatic drawing FIG. 3 is a general representation of a gas supplied pressurization, venting and control system; and is not necessarily all inclusive or exclusive of the components required in all cases to permit the invention to perform its functions; but only as a means for accomplishing the task of supplying, pressurizing, venting and controlling the gas in the air pockets.

The hull skirt 7 and braces 6 would preferably, but not necessarily, be made of similar material as the ships' underwater hull. In the case of a steel hulled ship, steel skirt 7 plates could be welded to the hull in the vicinity of the Full Load Water Level 9 and steel braces 6 could be welded onto and designed to provide structural support to the skirt as required, and also be welded to, preferably, the underwater hull portion of the ship, generally in the same planes as the surface ships' transverse frames 5*a* through 5*v*, as necessary. The braces and skirts shall be designed structurally strong enough to withstand the gas pressures and sea forces required of them. The skirt shall be water and air pressure tight with the hull.

Figure 4:
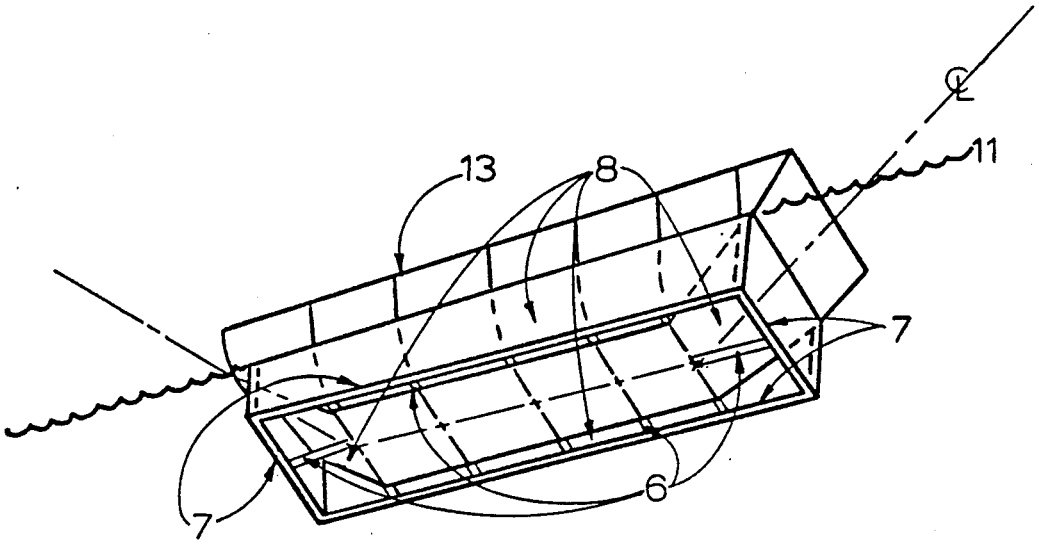
FIG. 4 is an isometric view illustration of a sea-pressured air pocket surface barge with a surrounding skirt encompassing the underwater portion of its hull.

A surface barge 13 with draft water level 11, skirt 7, air pockets 8, and braces 6 as shown in FIG. 4, represents a secondary embodiment of the invention when accompanied by a compressed gas source with its attendant pressure control and venting capabilities as shown generally by diagrammatic drawing, FIG. 3. The apparatus shown by FIGS. 3 and 4 are suitable for varying the barges' draft depth. The underwater hull with surrounding vertical skirt 7, with braces 6, and air pockets 8, commence in the vicinity of the Full Load Water Level shown by the draft water level 11 and extend essentially vertically downward to the vicinity of the hull baseline. When the barges' apparatus is active, it will function similarly to the ships' apparatus as previously described in the preferred embodiment. Structurally, it is also similar to the preferred embodiment, except the barges' skirt completely surrounds the underwater portion of the barges' hull as shown and does not necessarily begin at the bow end with a sharp tapered forward end as for the ship.

What is claimed is:

1. An apparatus of a water going vessel which comprises:

(a) A surface ship of underwater hull shape wherein the ratio of the volume of the water displacement to the volume of a block having the same length, breadth, and amidships draft is less than eighty nine hundreds when all dimensions are taken from the full load water line; and (b) with a surrounding vertical skirt commencing in the vacinity of the full load water level and extending to the vacinity of the hull baseline, while beginning at the bow with a rather sharp tapered forward end from top to bottom, and continuing around both starboard and port sides and terminating across the stern end just forward of the ships propeller area to provide for suitable propeller and rudder action; and (c) with underskirt structural braces between the skirt and the hull designed and located to provide mutually adequate strength to enable the skirt, braces, and hull to withstand the sea forces and underskirt gas pressures against them; and (d) with air pockets thereby formed in a substantially major portion of the bottom of the underwater hull and said air pockets having a bottom portion open to the water, a top portion corresponding to the underwater portion of the hull, and side portions corresponding to the undersides of the skirt; and (e) with a gas pressure control system consisting of compressed gas source(s) with relieving capabilities, controls, and conduit for the purpose of conveying and maintaining gas pressures within the ships skirt from the top of the sea-pressured air pockets to the underskirt water levels at variable gas pressures from atmospheric pressure to a maximum pressure just above the skirt bottom, as determined by the resulting differential water head pressure, so that the water levels within the skirt air pockets may be varied.

2. An apparatus of a water going vessel which comprises:

(a) A surface barge of underwater hull shape wherein the ratio of the water displacement to the volume of a block having the same length, breadth, and mean draft is less than ninety four hundreths when all dimensions are taken from the full load water line; and (b) with a surrounding vertical skirt commencing in the vicinity of the full load water level and extending essentially vertically downward to the vicinity of the hull baseline and thus surrounding the total underwater hull portion; and (c) with underskirt structural braces, between the skirt and the hull designed and located to provide mutually adequate strength to enable the skirt, braces, and hull to withstand the sea forces and the underskirt gas pressures against them; and (d) with air pockets thereby formed in essentially all of the bottom of the underwater hull and said air pockets having a bottom portion open to the water, a top portion corresponding to the undersides of the skirt; and (e) with a gas pressure control system consisting of compressed gas source(s) with relieving capabilities, controls, and conduit for the purpose of conveying and maintaining gas pressures within the barge skirt from the top of the sea-pressured air pockets to the underskirt water levels at variable gas pressures from atmospheric pressure to a maximum pressure just above the skirt bottom, as determined by the resulting differential water head pressure, so that the water levels within the skirt air pockets may be varied.

* * * * *